US005867835A

United States Patent [19]

Dabbieri

[11] Patent Number: 5,867,835

[45] **Date of Patent: *Feb. 9, 1999**

[54] SCARF WITH TWIST

[76] Inventor: Claudia Dabbieri, 214 Glen Ridge Ct., Columbia, S.C. 29212

[ * ] Notice: The terminal 19 months of this patent has been disclaimed.

[21] Appl. No.: 50,821

[22] Filed: Jun. 7, 1993

[51] Int. Cl.[6] ..... A41D 23/00

[52] U.S. Cl. ..... 2/207; 2/171

[58] Field of Search ..... 2/198, 207, DIG. 11, 2/171

[56] References Cited

U.S. PATENT DOCUMENTS

| | | | |
|---|---|---|---|
| 2,806,222 | 9/1957 | Carpenter | 2/207 |
| 3,748,661 | 7/1973 | Smith | 2/207 |
| 4,038,724 | 8/1977 | Parizek | 2/207 |
| 4,723,325 | 2/1988 | Perry | 2/207 |
| 5,144,696 | 9/1992 | Kahl | 2/207 |
| 5,233,704 | 8/1993 | Booher | 2/207 |

FOREIGN PATENT DOCUMENTS

| | | | |
|---|---|---|---|
| 1266509 | 10/1986 | U.S.S.R. | 2/207 |

*Primary Examiner*—Dianna Biefeld

[57] ABSTRACT

The Danae Scarf is an improved invention of a fashion accessory, one of neckwear apparel, referred to as a Scarf. The invention is designed to be draped about the wearer's neck and is comprised of a continuous circle of elongated tubular fabric having a neckband portion and a draping portion. The continuous circle is made from a single elongated rectangle of fabric wherein one free end of the elongated tube is twisted through 360 degrees about a longitudinal axis of the tube and attached to the other free end of the tube to form a one sided continuous circle of tubular fabric. A narrow neckband portion is then formed by accordion pleating/folding and securing circular tube at the intersection of the lengthwise/crosswise stitching thereby creating a neckband portion and a draping portion.

2 Claims, 5 Drawing Sheets

SCARF WITH TWIST

BRIEF SUMMARY

The Danae Scarf is an improvement over prior inventions that relate to neckwear apparel. The objectives of these improvements over prior inventions are to provide a scarf designed especially for feminine use that is easy to wear and that does not require any tying and/or closure manipulations whatsoever. My invention is easy for the wearer to use without the inherent diffictulties of said manipulations as found in 1. Conventional rectangular, triangular, and square scarves
2. The Cecile Herzberg Scarf, U.S. Pat. No. 3,e105,970
3. The Ray Steinberg Decorative Scarf, U.S. Pat. No. 4,321,709
4. The Claudia Dabbieri 9/1 Necktie, U.S. Pat. No. 4,613,992
5. The Judy Coppure Scarf, U.S. Pat. No. 4,942,627.

1. To provide an innovative scarf designed especially for feminine use that is easy for the wearer to make use of; a scarf that does not require any tying and/or closure manipulations whatsoever; one that is easy for the wearer to use without the inherent difficulties of said manipulations as found in 1. Conventional rectangular, triangular, and square scarves
2. The Cecile Herzberg Scarf, U.S. Pat. No. 3,105,970
3. The Ray Steinberg Decorative Scarf, U.S. Pat. No. 4,321,709
4. The Claudia Dabbieri 9/1 Necktie, U.S. Pat. No. 4,613,992
5. The Judy Coppure Scarf, U.S. Pat. No. 4,942,627

2. In conjunction with the first objective the second objective of this improved invention is to provide a scarf that requires few (three steps or less) manipulations of folding, twisting, knotting, or any manner of tying, while non the less retaining the general appearance and variety of styles found with many conventional scarves.

3. In conjunction with the first and second objectives, the third objective is to provide an improved scarf that is comfortable for the wearer; a scarf that does not require tightness around the neck and one that resumes or retains its style regardless of external conditions such as body movements or wind.

4. The third objective of improvement over prior inventions is one of simplicity of design and manufacture.

5. The fourth objective of improvement is one of a reduced cost over prior inventions using comparably priced fabric materials.

BRIEF DISCRIPTION OF DRAWINGS

FIG. 1. is a plan view showing the Danae Scarf constructed with a 360 degree twist in the draping portion and a narrow band of accordion pleats secured in the neckband portion.

FIG. 2. is a view showing the Danae Scarf as it is displayed around the neck to be worn in a loose free-flowing style having the neckband portion to the back of the wearer's neck and the draping portion to the front of the wearer's neck.

FIG. 3. shows a sample pattern for cutting scarves continuously on a folded piece of statdard 45" fabric.

FIG. 4. shows a pattern for cutting scarves continuously on a folded piece of standard 60" fabric.

FIG. 5. shows the lengthwise stitching path to be taken which creates an open ended elongated tube of fabric.

FIG. 6. shows one free end of the tube twisted through 360 degrees about the longitudinal axis before further stitching of the scarf open ends takes place.

FIGS. 7*a*. and 7*b*. show the neckband portion wherein the crosswise stitching path connects the tube endings and forms a continuous circle of tubular fabric.

FIGS. 8*a*. and 8*b*. show the folding and stitching path of an accordion pleat, also known as a double box pleat, to be made at the intersection of the lengthwise and crosswise stitching thereby creating the narrow neckband portion of the scarf.

FIG. 9. cut away view shows stitching which goes through all layers of accordion pleating to permanently secure narrow neckband portion of scarf in position.

DETAILED DESCRIPTION

Figure 1:
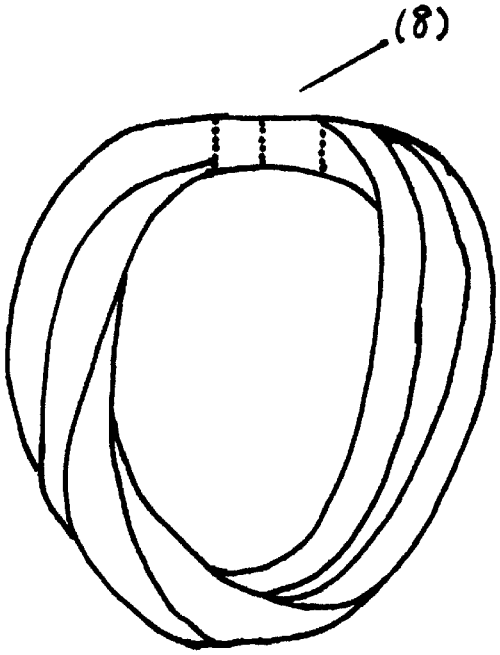

The Danae Scarf is an improved invention of neckwear apparel comprised of a continuous circle of tubular fabric of sufficient size to encircle the wearers neck more than one full time around and possibly, but not exceeding, two times around. The continuous circle is made from an elongated rectangle of a single layer of fabric (1) which is connected lengthwise (2) to form an open ended tube. A half or full twist (3) is made in the tube and then the tube endings are attached to form a continuous circle (4). A narrow neckband portion is then formed by accordion pleating and folding (5) and then securing (6) the neckband portion of the scarf, at the intersection (4) of the lengthwise/crosswise stitching of the elongated tube.

The rectangel may be any size from approximately 30" to 52" lengthwise and 12" to 20" crosswise. The most optimum rectangle for manufacturing and styling purposes seems to be 15" crosswise and 40" lengthwise unfinished. For draping purposes the scarf is comprised of one layer of fabric. The single layer rectangle may be cut on the straight or the bias of the fabric.

The neckband portion (8) of the scarf is considered to be the intersection (4) of the crosswise/lengthwise seams. For ease of wear, comfort, and draping purposes, a narrow neckband portion (8) by pleating, folding, (5) and (tacking) securing (6) at or around this intersection.

Figure 2:
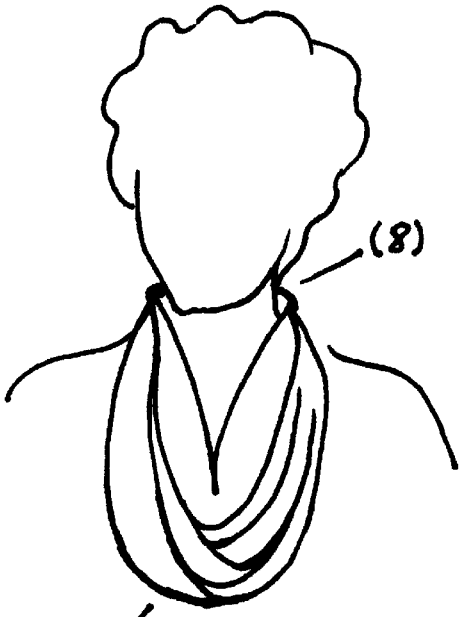

The draping portion of the scarf (7) is considered to be that portion of fabric in the circle that begins diametrically opposit the neckband and extends from that point around the circle in both directions to within a few inches of the neckband portion (8). See FIGS. 1 and 2.

Figure 3:
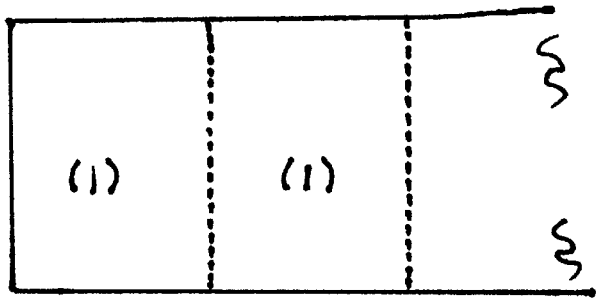
Figure 4:
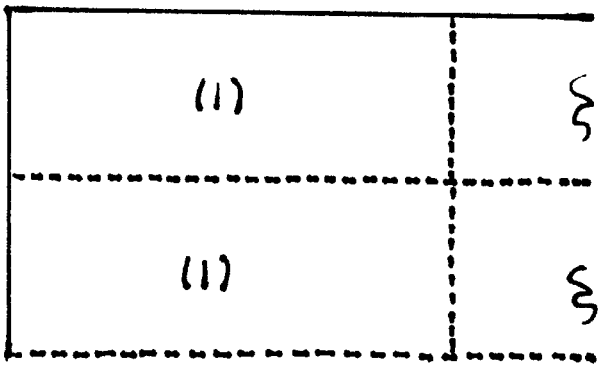

My invention requires one piece of fabric (1) for the making of one scarf. FIGS. 3 and 4 show patterns for the cutting and continuous cutting of elongated rectangles which may accomodate any length of fabric. With slight variations in the width/length of the rectangle, no waste of fabric is necessary.

Figure 5:
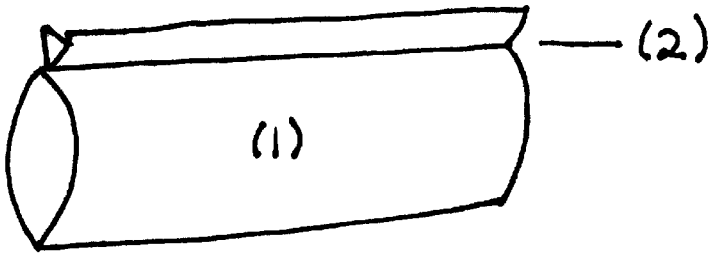

The rectangle of fabric is folded lengthwise with right side of fabric inside; the two cut edges of the rectangle are aligned and equidistant from the folded edge. Stitch a ½" seam (2) lengthwise along the cut edges of the rectangle. The rectangle now forms a tube that is approximately 14" around the perimeter of the open ends and 40" long when making the optimum standard size. See FIG. 5.

Figure 6:
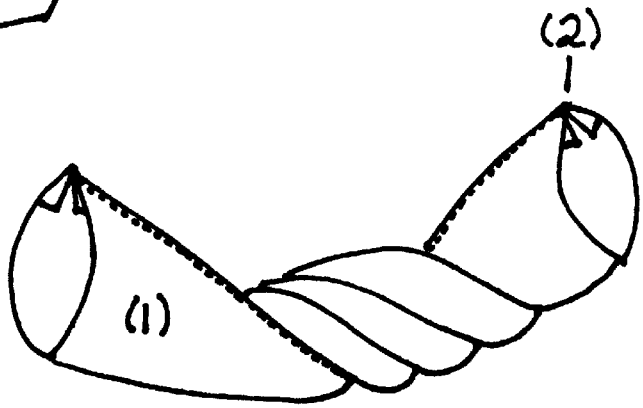
Figure 7A:
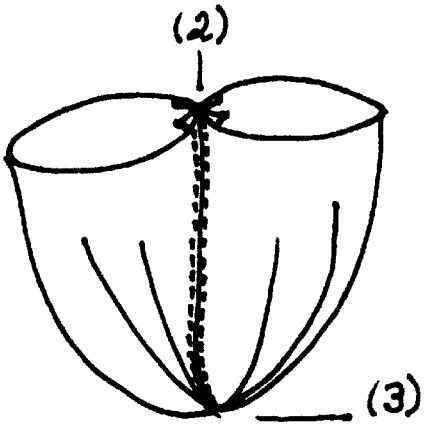
Figure 7B:
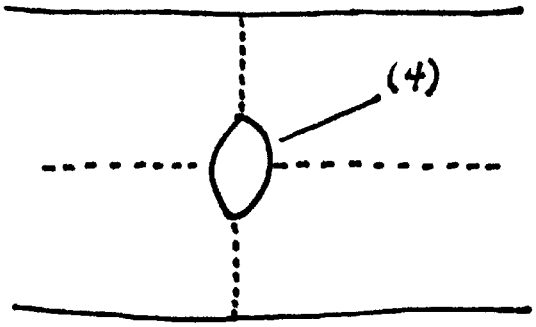

Turn right side out. One free end of the elongated tube is twisted through 180 degrees or 360 degrees about a longitudinal axis of the tube. See FIG. 6 (3). Attach to the other free end of the tube. See FIG. 7*a*.(2) This may be done by creating what is commonly referred to as a 'Mobius Strip' or a 'Double Mobius'. For draping purposes the 'Double Mobius' is the preferred method.

The twist (3) is fundamental to the design concept (and the stated primary objective) in that it allows the scarf to drape without puckering. The 360 degree twist more fully accomodates the draping by "rolling" the center of the draping portion rather than have that portion buckled. With the right side of the fabric facing out (seam allowances (2) inside) and the twist (3) 180 degrees or 360 degrees in place, attach the two ends of the tube together (4) with the right sides of the edges facing. Turn the unsewn opening edges inward; top stitch the opening to form a continuous circle of tubular fabric (4).

The making of a narrow neckband portion which inherently includes more folds in the draping of the scarf is an improvement on prior art. There is nothing in the prior art with a narrow neckband portion. Mine is the only invention that has a neckband portion within a continuous circle of tubular fabric. Neither Carpenter or Slonimskii disclosures suggest a neckband portion.

Figure 8A:
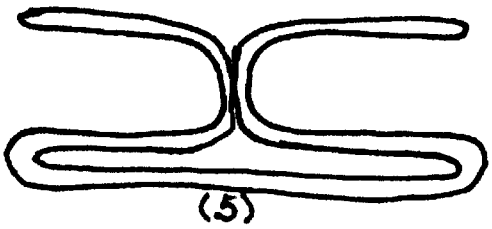
Figure 8B:
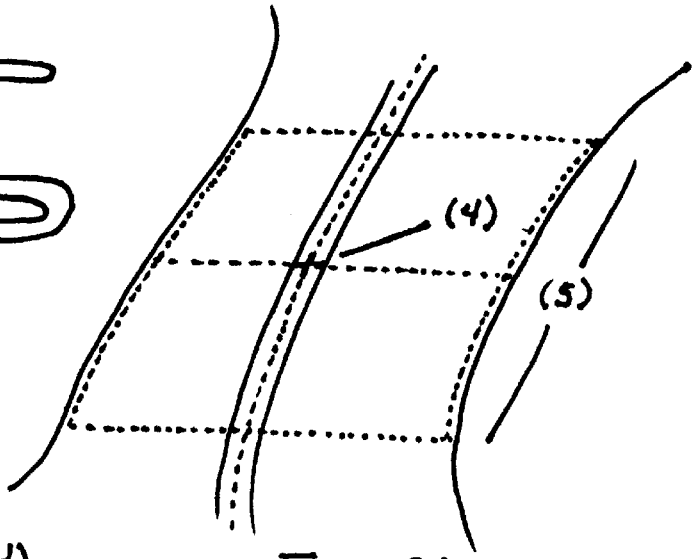
Figure 9:
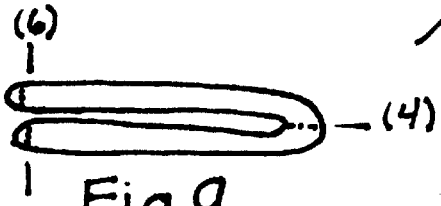
Figure 10:
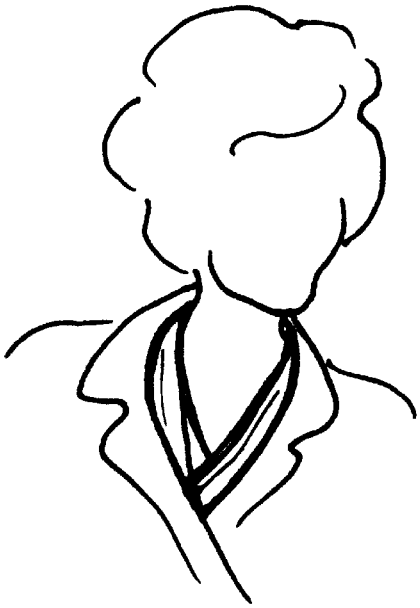
Figure 11:
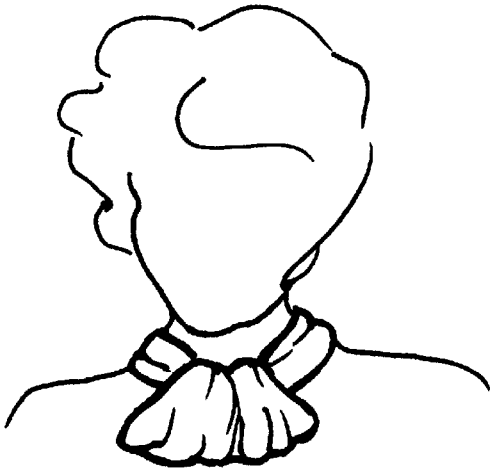
Figure 12:
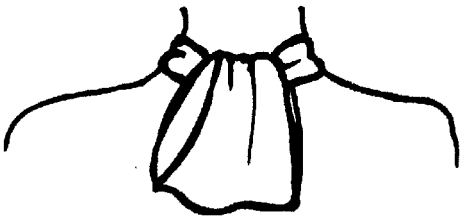
Figure 13:
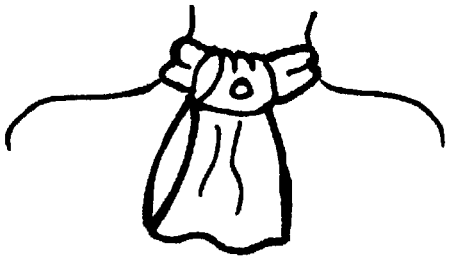
Figure 14:
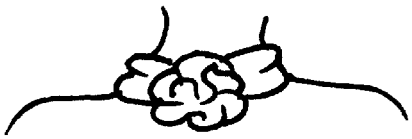
Figure 15:
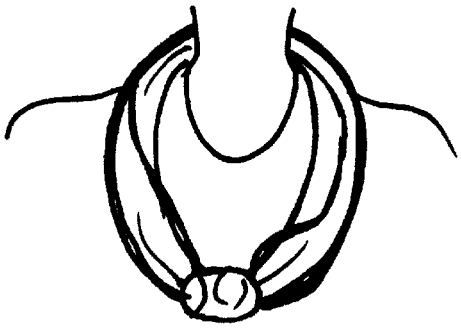
Figure 16:
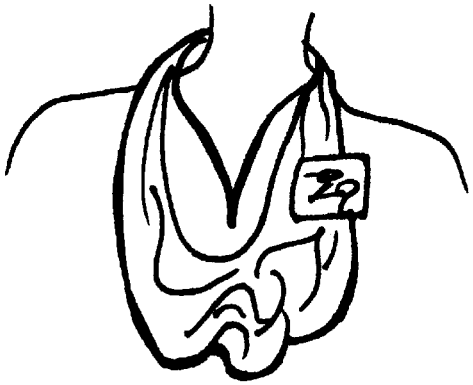
Figure 17:
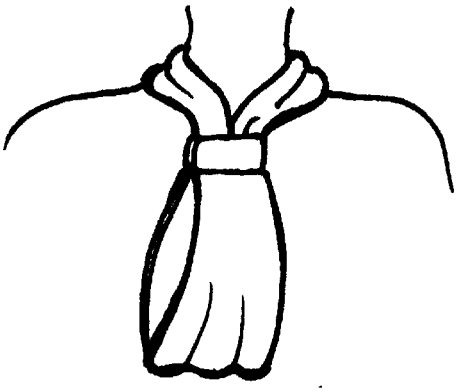
Figure 18:
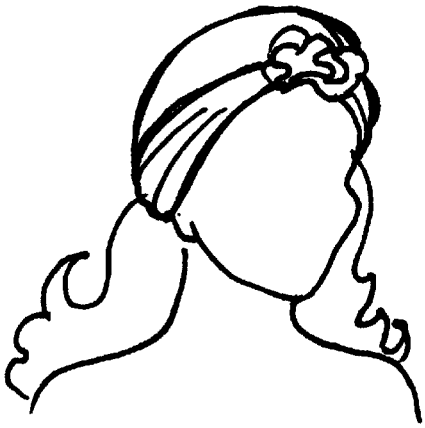
Figure 19:
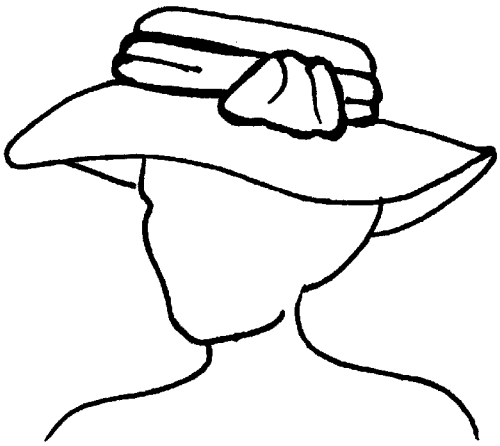
Figure 20:
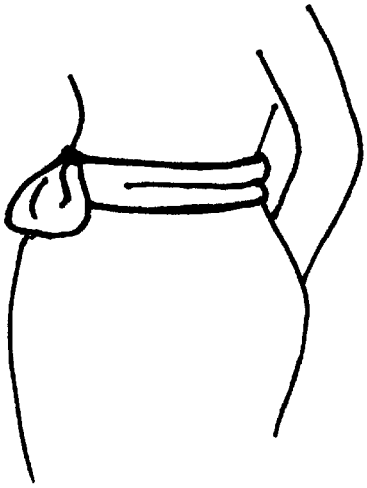
Figure 21:
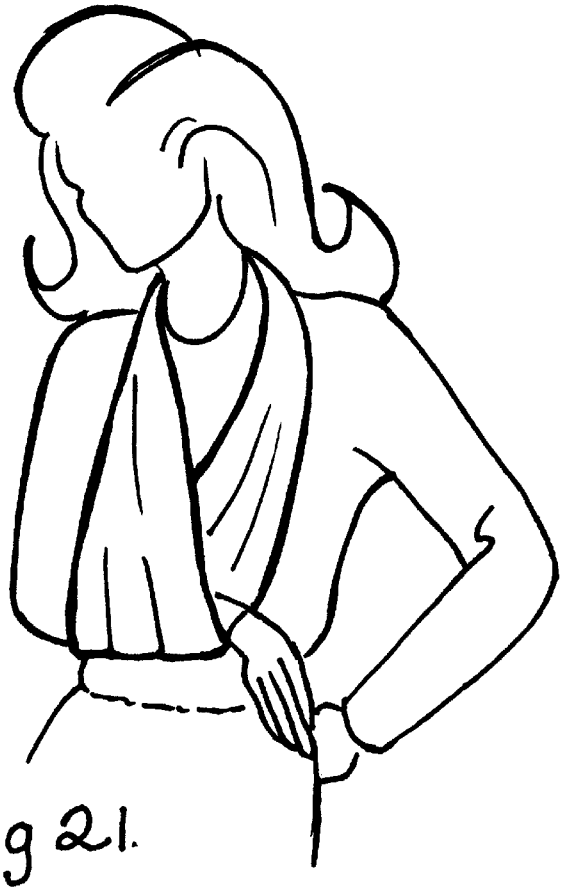

To begin making the narrow neckband portion locate the intersection (4) of the crosswise/lengthwise seams. Working crosswise there are a number of ways to reduce the neckband width(, i.e., gather, accordion pleat, etc). The preferred method is to form a box pleat , also known as an accordion pleat, (5) lengthwise on each side of the lengthwise seam with the pleat doubling back to cover the full width of the band. See FIG. 8*b*. Stitch completely around the accordion pleats. The neckband width is now approximately 2½". An additional improvement is made by the folding of the accordion pleats, one side over the other (6). This reduces the width of the neckband to little more than an inch and introduces another fold into the draping quality of the scarf. Topstitch the fold into place either beside or on top of box pleat stitching.

If the scarf is made of a wrinkling fabric the scarf is ready to be pressed and worn.

I claim:

1. A scarf designed to be draped about a warer's neck comprised of;

an elongated tube of fabric having two free ends;

wherein one free end of the elongated tube is twisted through 360 degrees about a longitudinal axis of the tube and attached to the other free end of the tube at a seam to form a continuous circle of tubular fabric;

the circle of tubular fabric having a neckband portion and a draping portion;

wherein the seam attaching the two free ends of the tube of fabric is positioned within the neckband portion;

the neckband portion having accordion pleats sewn therein whereby the neckband portion is narrower in width than the draping portion.

2. A scarf designed to be draped about a wearer's neck comprised of;

an elongated tube of fabric having two free ends;

wherein one free end of the elongated tube is twisted through 180 degrees about a longitudinal axis of the tube and attached to the other free end of the tube at a seam to form a continuous circle of tubular fabric;

the circle of tubular fabric having a neckband portion and a draping portion;

wherein the seam attaching the two free ends of the tube of fabric is positioned within the neckband portion;

the neckband portion having accordion pleats sewn therein whereby the neckband portion is narrower in width than the draping portion.

* * * * *